US010456762B1

(12) United States Patent
Weiss et al.

(10) Patent No.: US 10,456,762 B1
(45) Date of Patent: Oct. 29, 2019

(54) MACHINE FOR MIXING AND CONVEYING A ROAD APPLICATION MIXTURE AND THE METHODS OF USE THEREOF

(71) Applicant: Juneau County, a Wisconsin body corporate, Mauston, WI (US)

(72) Inventors: Dennis Wilfred Weiss, Mauston, WI (US); Steven Donald Peters, Necedah, WI (US); Thomas Alan Wolfe, Wonewoc, WI (US)

(73) Assignee: Juneau County, a Wisconsin body corporate, Mauston, WI (US)

( * ) Notice: Subject to any disclaimer, the term of this patent is extended or adjusted under 35 U.S.C. 154(b) by 604 days.

(21) Appl. No.: 14/965,370

(22) Filed: Dec. 10, 2015

Related U.S. Application Data

(60) Provisional application No. 62/138,917, filed on Mar. 26, 2015.

(51) Int. Cl.

| | |
|---|---|
| ***B01F 15/00*** | (2006.01) |
| ***B01F 3/12*** | (2006.01) |
| ***B01F 7/00*** | (2006.01) |
| ***B01F 15/02*** | (2006.01) |

(52) U.S. Cl.
CPC ..... *B01F 15/00331* (2013.01); *B01F 3/1221* (2013.01); *B01F 7/00416* (2013.01); *B01F 15/00129* (2013.01); *B01F 15/0243* (2013.01)

(58) Field of Classification Search
CPC ..... B01F 7/00416; B01F 15/00331; B01F 3/1221; B01F 15/00129; B01F 15/0243
USPC ..... 366/38
See application file for complete search history.

(56) References Cited

U.S. PATENT DOCUMENTS

| | | | | |
|---|---|---|---|---|
| 2,536,319 A | | 1/1951 | Slack | |
| 3,298,190 A | | 1/1967 | Harker | |
| 3,947,169 A | * | 3/1976 | Wolff | B29C 47/10 264/211 |
| 4,187,030 A | | 2/1980 | Godley | |

(Continued)

FOREIGN PATENT DOCUMENTS

EP 0012486 6/1980

OTHER PUBLICATIONS

Bunn, Bunn Altra-2 Granita Margarita Machine—High Performance, as viewed at https://primasupply.com/equipment/bunn/340000080#.VN_NIPnF9BE on Feb. 14, 2015 (2 pages).

(Continued)

*Primary Examiner* — Anshu Bhatia
(74) *Attorney, Agent, or Firm* — Brennan Law Office, LLC

(57) ABSTRACT

The present invention relates to a machine for mixing and conveying a road application mixture and to the methods of use thereof. A hopper has a top and bottom and contains a selected amount of solid material useful for melting snow and ice. An auger casing with a solid inlet is attached to the bottom of the hopper and is oriented in an inclined plane. A tank containing a liquid is connected to the auger casing at a liquid inlet. The hopper has a discharge at a distal end. An auger is contained within the auger casing for conveying the solid material and mixing it with the liquid material. The auger has a first flight section with a first pitch and a second flight section with a second pitch and with cross bars. The auger housing has a discharge. The auger can be started remotely.

17 Claims, 6 Drawing Sheets

(56) References Cited

U.S. PATENT DOCUMENTS

| | | | | |
|---|---|---|---|---|
| 4,442,979 | A | 4/1984 | Kupper | |
| 5,931,393 | A | 8/1999 | Alsip et al. | |
| 6,058,721 | A | 5/2000 | Midden et al. | |
| 6,080,330 | A | 6/2000 | Bloomer | |
| 6,176,090 | B1 | 1/2001 | Ufema | |
| 6,349,570 | B1 | 2/2002 | Coates et al. | |
| 6,398,979 | B2 | 6/2002 | Koefod et al. | |
| 6,446,879 | B1 | 9/2002 | Kime | |
| 6,596,188 | B1 | 7/2003 | Hartley et al. | |
| 6,641,753 | B1 | 11/2003 | Bloomer | |
| 8,025,245 | B2 | 9/2011 | Truan et al. | |
| 8,137,578 | B2 | 3/2012 | Koctod | |
| 8,662,422 | B2 | 3/2014 | Ward et al. | |
| 2009/0238031 | A1* | 9/2009 | Conard ..... | B01F 7/00708 366/162.2 |

OTHER PUBLICATIONS

Sharpe Mixers, Sharpe Helix Impeller, as viewed at http://www.sharpemixers.com/helix.html on Feb. 12, 2015 (1 page).

Wisconsin Transportation Information Center, Wisconsin Transportation Bulletin—No. 22, Pre-wetting and Anti-icing—Techniques for Winter Road Maintenance, 2005 (8 pages).

* cited by examiner

MACHINE FOR MIXING AND CONVEYING A ROAD APPLICATION MIXTURE AND THE METHODS OF USE THEREOF

This patent application claims priority on and the benefit of provisional application 62/138,917, filed Mar. 26, 2015, the entire contents of which are hereby incorporated herein by reference.

BACKGROUND OF THE INVENTION

1. Field of the Invention

The present invention relates to a machine for mixing and conveying a road application mixture and to the methods of use thereof.

2. Description of the Related Art

The use of solid and liquid melting materials as an application to roadways in winter conditions is well known. Road salt can be affective in melting snow and ice. However, the application of dry salt can be less then fully optimal. For example, the dry salt can spread from the intended application area and leave the road way. This leads to the consumption of more salt than required. Several patents have been developed over the years attempting to improve the use of road salt or the use of a simple road salt spreader truck.

One patent, U.S. Pat. No. 5,931,393 to Alsip et al. is titled Salt-Sand Spreader with Liquid Injector. It shows a salt-sand spreader for use for spreading materials onto road surfaces primarily where icing or slippery conditions occur. The spreader includes an applicator for coating the particles with a liquid prior to discharging the particles to tend to speed up the ice melting reaction and if a suitable coating is used to inhibit corrosive action of the salt. Additionally, the velocity of discharge of the particles from a discharge mechanism is sensed or correlated to fan speed and the discharge velocity is adjusted to match the forward speed of the vehicle so that there is essentially zero relative velocity between the particles and the ground when the particles strike the ground.

Another patent, U.S. Pat. No. 6,398,979 to Koefod et al. is titled Deicer and Pre-Wetting Agent. It shows a liquid deicer composition suitable for use as a deicer or as a pre-coat for solid deicers is disclosed. The composition typically includes molasses solids, magnesium chloride, and a corrosion inhibitor. In one implementation the liquid deicer composition includes molasses solids; magnesium chloride, and a corrosion inhibitor.

A further patent, U.S. Pat. No. 6,446,879 to Kime is titled Method and Apparatus for Depositing Snow-Ice Treatment Material on Pavement. It shows an apparatus and method for depositing salt granular materials upon a highway pavement at practical speeds. A highway truck is utilized which employs two spaced apart ejector mechanisms which function to deposit a continues narrow band of mixed salt and brine just forwardly of and in the path of travel of the two rearward truck wheel assemblies. This not only provides enhanced traction for these rear truck wheels, but also functions to utilize the rear wheels to compact the continuous narrow band pile of salt into pavement borne ice formations. Granular salt is delivered to the two ejector mechanisms utilized from a truck bed having a flat surface beneath which is a centrally disposed bed auger transport mechanism formed of two independently driven augers. These augers deliver salt to a cross auger mechanism mounted forwardly of the bed and which both supports and delivers salt to the two spaced apart ejectors. A brine formation assembly also is mounted upon the truck frame rearwardly of the truck cab and forwardly of the bed. By selectively actuating one or the other of the bed augers, granular salt and brine may be ejected from an elected one or both of the ejector mechanisms. This brine supply also is used for coating dry bridge decks prior to imminent icing weather.

A still further patent, U.S. Pat. No. 8,025,245 to Truan et al. is titled Material Spreader with Integrated Wetting System. It shows a material spreader having a hopper for containing material and a liquid tank containing liquid adjacent the hopper. The liquid tank has a passage extending from the hopper through the tank with a discharge opening. An auger extends through the hopper and passage for conveying material to the outlet for delivery to a spinner for distributing the material. At least one nozzle is mounted in the passage for spraying liquid onto the material as it is being conveyed through the passage.

A still further patent, U.S. Pat. No. 8,662,422 to Ward et al. is titled Apparatus for Treatment of Snow and Ice. It shows a vehicle is disclosed which includes a chassis and a storage and dispensing apparatus. The storage and dispensing apparatus can be mounted directly to the chassis or disposed within or on a body, which in turn is mounted to the chassis. The storage and dispensing apparatus has an opening therein to permit material to be transported therethrough. A conveyor assembly for selectively conveying materials from the opening of the storage and dispensing apparatus is also included. The conveyor assembly can include a dual auger arrangement. The vehicle includes a spreader chute that is operably arranged with the conveyor assembly to direct the materials to a spreader. A liquid storage system for storing liquid is provided. A liquid dispensing system is provided for selectively dispensing liquid from the liquid storage system. The liquid dispensing system includes an anti-icing system for selectively dispensing liquid from the vehicle and a pre-wetting system for selectively dispensing liquid onto material being transported by the endless conveyor out of the vehicle.

While the items shown in each of these patents may work well for their intended purposes, none solve the problems solved by the present invention.

Thus there exists a need for a machine for mixing and conveying a road application mixture and to the methods of use thereof that solves these and other problems.

SUMMARY OF THE INVENTION

The present invention relates to a machine for mixing and conveying a road application mixture and to the methods of use thereof. A hopper has a top and bottom and contains a selected amount of solid material useful for melting snow and ice. An auger casing with a solid inlet is attached to the bottom of the hopper and is oriented in an inclined plane. A tank containing a liquid is connected to the auger casing at a liquid inlet. The hopper has a discharge at a distal end. An auger is contained within the auger casing for conveying the solid material and mixing it with the liquid material. The auger has a first flight section with a first pitch and a second flight section with a second pitch and with cross bars. The auger housing has a discharge. The auger can be started remotely.

According to one advantage of the present invention, the auger conveys the solid material and mixes it with the liquid material as it is conveyed. This advantageously results in the solid being fully wetted within the auger casing.

According to another advantage of the present invention, the user can start the auger remotely from within his or her cab. This results in increased efficiency as the mixture is created on demand and the user may remain in their cab while the mixture is created.

According to a further advantage of the present invention, a pump can be provided for introducing liquid into the auger casing. The pump can turn on automatically after the auger passes through an amperage parameter or torque parameter and likewise turns off once the amperage or torque decreases to or approaches the empty amperage or torque threshold. This ensures that liquid is not introduced into the auger casing unless there is solid material for it to mix with.

According to a further advantage of the present invention, the auger can have a first pitch flight in a first auger section and a second pitch flight in a second auger section. Advantageously, the change in pitch flight speeds up the rate of conveyance in the second flight section to enhance mixability and prevent plugging.

According to a still further advantage of the present invention, the auger can have at least one cross bar in the second auger section. The cross bar can be round to suitably perform the mixing function while minimizing damage to the desired size of the solid material.

According to another advantage of the present invention, the cross bar or cross bars can be oriented generally parallel to an auger longitudinal axis. In this regard, the cross bar or cross bars have a minimum effect on the conveying nature of the auger thereby limiting auger power consumption.

Round bars to increase mixing yet not minimize damage to solid structure.

In an alternative embodiment, rounds bars extend perpendicularly away from the auger shaft between the flights. The perpendicular bars aid in mixing of the solids and liquids.

According to a still further advantage of the present invention, the auger casing and auger can be held in an inclined plane to increase mixing ability and to prevent liquid from short circuiting.

Other advantages, benefits, and features of the present invention will become apparent to those skilled in the art upon reading the detailed description of the invention and studying the drawings.

DETAILED DESCRIPTION OF PREFERRED EMBODIMENTS

Figure 1:
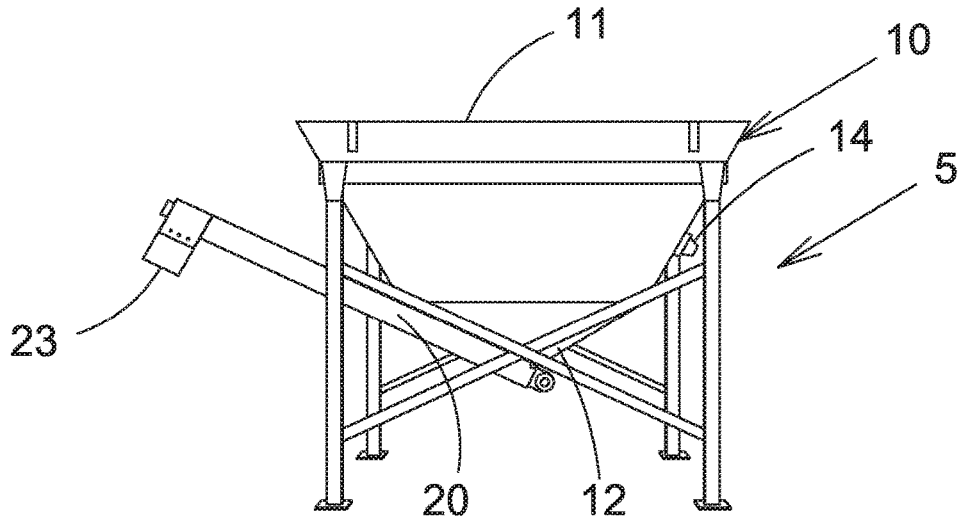
FIG. 1 is a side view of a preferred embodiment of the present invention.
Figure 2:
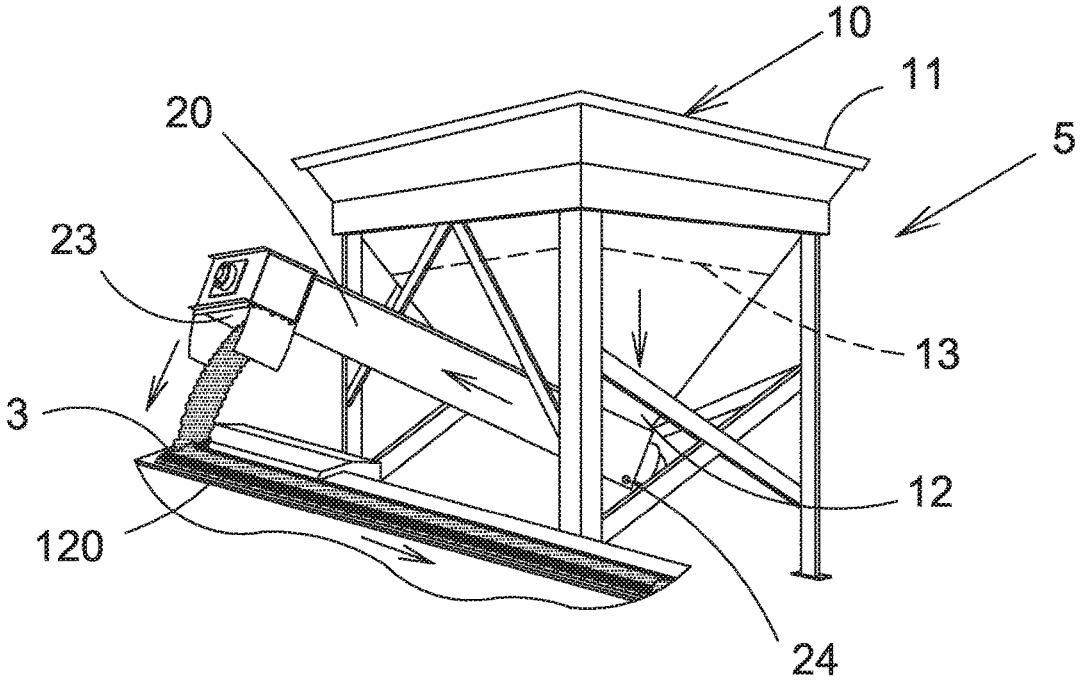
FIG. 2 is perspective view of the embodiment illustrated in FIG. 1.
Figure 3:
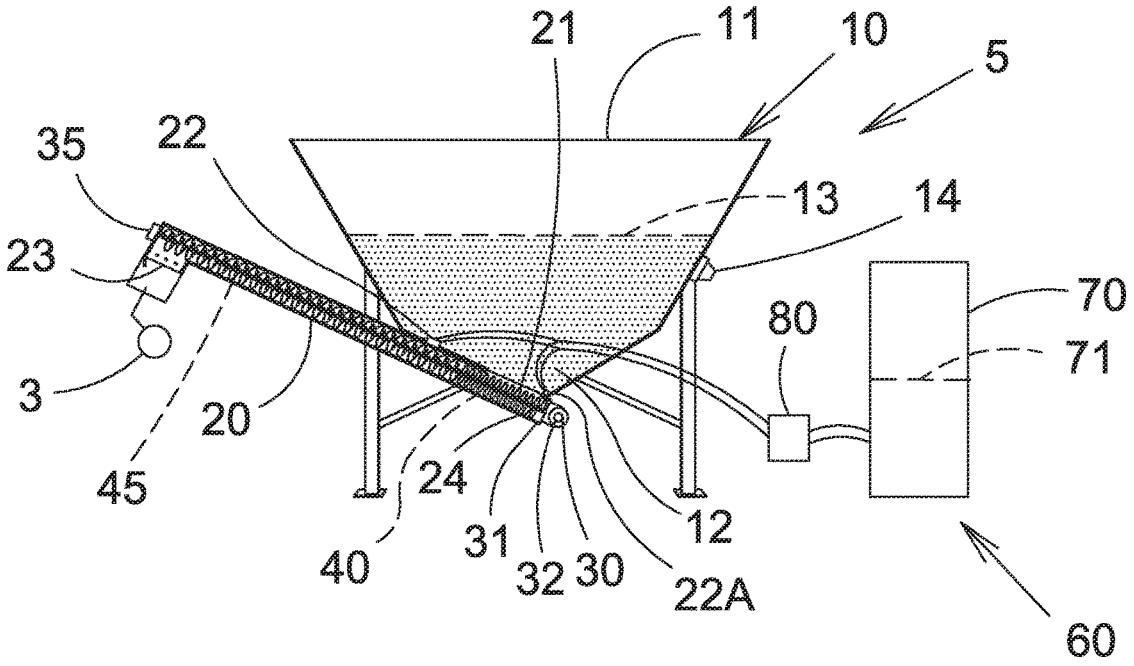
FIG. 3 is a schematic drawing of a preferred embodiment of the system.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Turning now to FIGS. 1-6, it is seen that a preferred embodiment of the system 5 of the present invention is illustrated that is useful to mix a solid material 13 with a liquid 71 to form a wetted mixture 3.

The system 5 has a hopper 10 having a top 11 and a bottom 12. The hopper can contain an amount of a solid material 13 such as road salt. The material 13 is preferably a snow and ice melting agent. It can be mixed with sand or another abrasive type agent for increasing traction on roadways. The hopper preferably also has a bin vibrator 14 to ensure flow from the hopper by preventing clogging and a safety grate.

An auger casing 20 is also provided. The auger casing 20 has a solid inlet 21, a liquid inlet 22 (or multiple inlets 22 and 22A) and a discharge 23. The auger casing 20 has an axis that is preferably oriented on an incline with the discharge 23 being at the upper end and the solid inlet 21 at the lower end. The solid inlet is preferably at one end of the casing and the discharge is at the second end, or distal end, of the casing 20. The liquid inlet 22 is preferably between the solid inlet 21 and the discharge 23. A drain plug 24 is also provided on the bottom side of the auger casing 20. Liquid inlet 22A can be used to supplement the liquid injection when inlet 22 provides insufficient injection quantities (or be an alternative location therefore). Inlet 22 can be located between the solid inlet 21 and the discharge 23. Inlet 22A can be located between the solid inlet 21 and the lower end of the auger casing 20.

An auger 30 is further provided and is received within the auger casing 20. The auger 30 has a first end 31 to which an auger drive 32 is attached, and a second end 35. The auger has flights 41 that are in a first flight section 40 and flights 46 that are in a second flight section 45. Materials advance between an auger shaft and the auger casing on account of the rotation of the flights. The pitch of flights 41 is preferably 8 inches and the flight section is preferably 4 foot in length, and the pitch of flights 46 is preferably 12 inches and the section 45 is preferably about 11 feet in length. The significance of the change in pitch is that the materials move more quickly in the second section 45. The increase in speed, on accord of the change in flight pitch, increases the mixing ability and reduces the chance of plugging or packing within the auger casing. The auger 30 preferably turns at a rate of 125 rpm. However, this rotational speed could be greater or smaller without departing from the broad aspects of the present invention.

A first rod 50 and a second rod 51 are provided. The rods are generally parallel with the auger central axis. The rods are preferably at the outer edge of the flights 46 in the second flight section of the auger 30. In this regard, the rods are effective at mixing the solid and liquid materials that have been introduced into the auger casing. The rods are preferably round rods. In this regard, they are effective at mixing but have a minimal impact on or cause minimal damage to the solid material. It is appreciated that while two rods are illustrated, that more or fewer can be provided without departing from the broad aspects of the present invention. It has been found that having at least one rod is effective for this aspect of the present invention.

The auger and auger casing are preferably held in an inclined plane to increase mixing ability and to prevent liquid short circuiting. In a preferred embodiment, the angle is 30 degrees from horizontal, with end 31 being below end 35. However, this angle could be more or less without departing from the broad aspects of the present invention. The liquid inlet 22 is located at a location above the solids inlet 21 due to the incline of the auger and casing.

Figure 4:
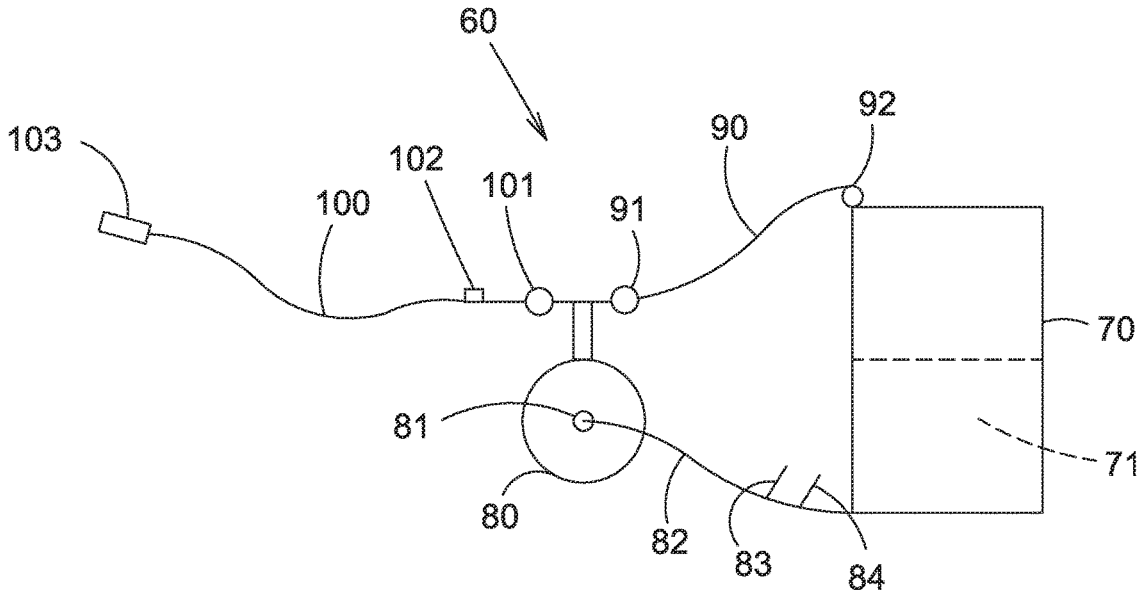
FIG. 4 is a schematic drawing of a preferred embodiment of a liquid application system of the present invention.
Figure 5:
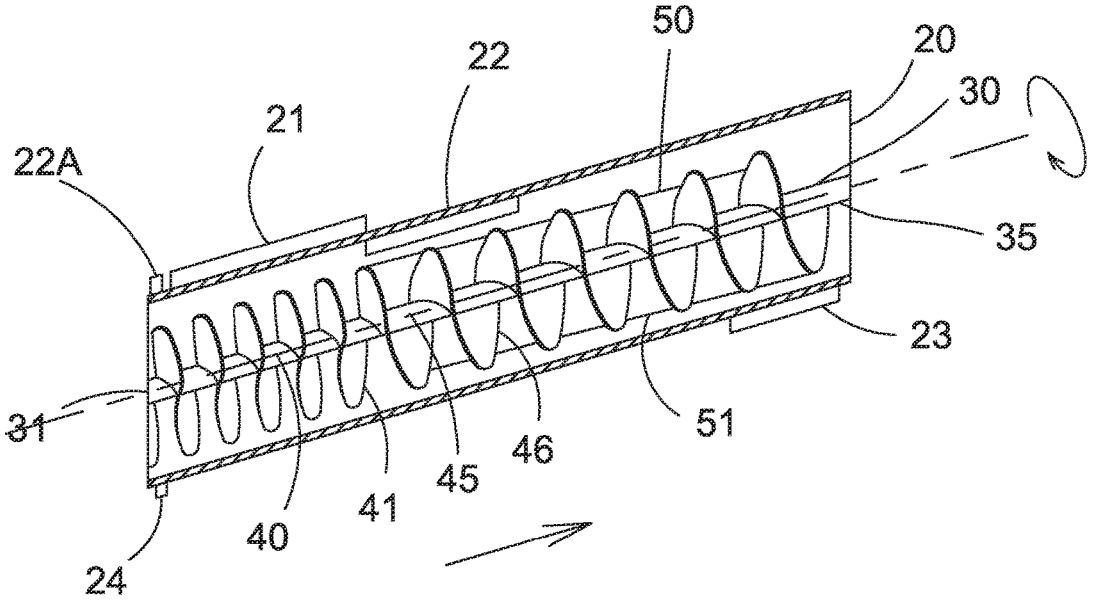
FIG. 5 is a side view of a preferred embodiment of an auger within an auger casing.
Figure 6:
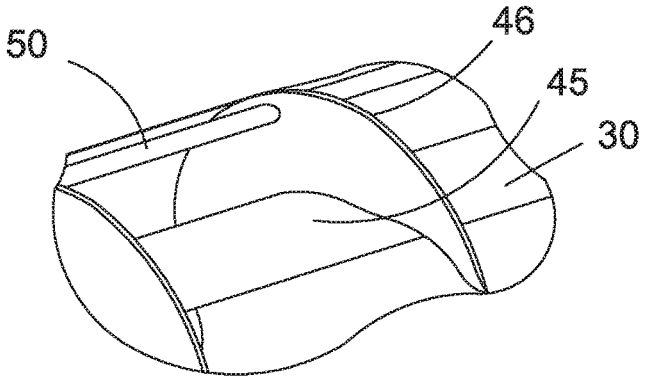
FIG. 6 is a close up side view showing a cross bar at the outer edge of an auger flight.

Turning now to FIG. 4, it is seen that a preferred embodiment of a liquid application system 60 is illustrated. The liquid application system 60 has a tank 70 for holding an amount of liquid 71. The liquid can be a wetting agent, a melting agent, an anti-corrosive agent or a combination thereof.

A pump 80 is provided having an intake 81. An intake line 82 is provided from the tank 70 to the pump 80. A tank valve 84 and a 12 volt valve 83 are provided. The tank valve 84 is a main on and off valve. The 12 volt valve is opened when the pump is activated and closed when the pump is deactivated, thereby keeping excess flow of liquid from escaping from the liquid system when not in use.

A T-fitting is provided with a return hose 90 connected to one side of the T-fitting. The return hose 90 has a return valve 91 and a check valve 92. An auger hose 100 is on the other side of the T-fitting. The auger hose 100 has a flow valve 101, a flow meter 102 and a check valve 103. The flow valve is at the end of the auger hose 100 adjacent to the liquid inlet whereby it can be shut to prevent further amounts of liquid from entering the auger casing.

The check valves are present to prevent back flows of the liquid.

The return valve 91 and the flow valve 101 are adjustable in response to a reading from the flow meter 102, whereby flow to the auger casing can be adjusted and regulated to a predetermined rate.

Pump is activated and deactivated by the amperage or torque draw on the auger. As material begins to be conveyed by the auger, the amperage or torque increases. The pump is programmed to start at a start point preferably just above the empty amperage draw. This ensures that the pump will not activate with an empty auger casing. Similarly, the pump is designed to deactivate as the auger casing begins to clean out or become fully emptied and the amperage or torque again approaches the empty amperage or torque draw. In this regard, the pump does not introduce further liquid into the casing when there is no solid material to mix with.

A user can start the auger motor remotely by utilizing a control in the cab of their loader. In a preferred embodiment, about 6 to 8 gallons is mixed with about 1 ton of solid material. This ratio can change depending on specific materials used, the air conditions, the road conditions, and other factors. In one embodiment, about 2 to 2.5 tons of mixture (solid and liquid) can be mixed and conveyed in a minute.

As seen in FIG. 1, the mixture can be deposited onto a mixture conveyor 120. However, it is understood that the mixture could be deposited directly into a loader or into trucks without departing from the broad aspects of the present invention.

Figure 7:
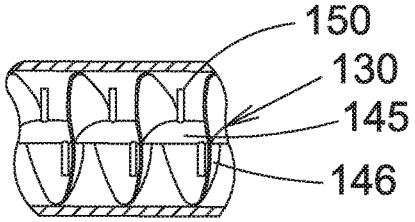
FIG. 7 is a perspective view of an alternative auger.
Figure 8:
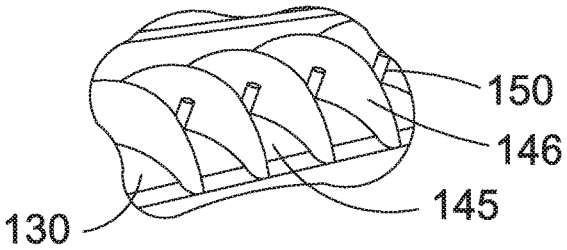
FIG. 8 is an alternative view of the auger shown in FIG. 7.
Figure 9:
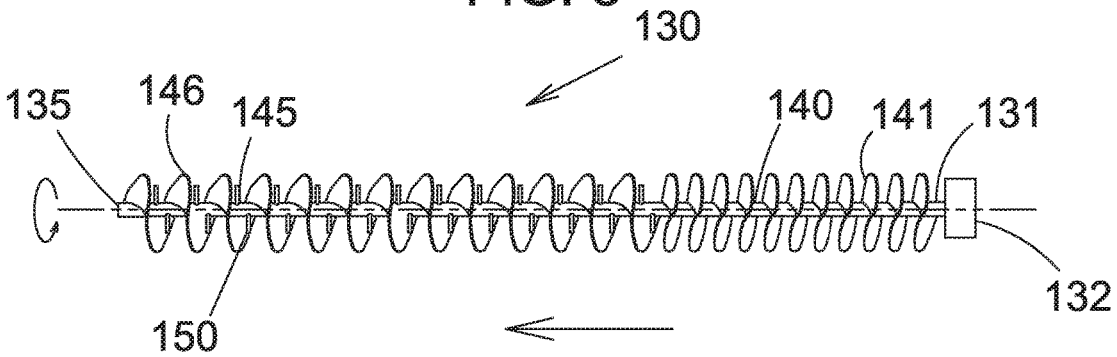
FIG. 9 is a schematic view showing the auger shown in FIG. 7.

Turning now to FIGS. 7-9, it is seen that an alternative embodiment of an auger 130 is provided. Auger 130 has an end 131 with a drive 132 and a second end 135. A first flight section 140 with flights is provided. The first section has a flight pitch of about 8 inches and is about 4 feet in length. A second flight section 145 with flights 146 is also provided. The second section 145 has a flight pitch of about 12 inches and is about 11 feet in length. Several rods 150 are provided and extend perpendicularly away from the auger 130 between the flights 146 of the second section 145. Each rod, or peg, is preferably about 3.5 inches long. There are no bars in the first section.

In both auger embodiments, the auger casing liquid inlet (or inlets) is at the start of the second section. In this regard, the mixing bars are positioned and operable from the time the liquid is introduced to the auger casing and auger until the time the mixture exits from the casing.

Figure 10:
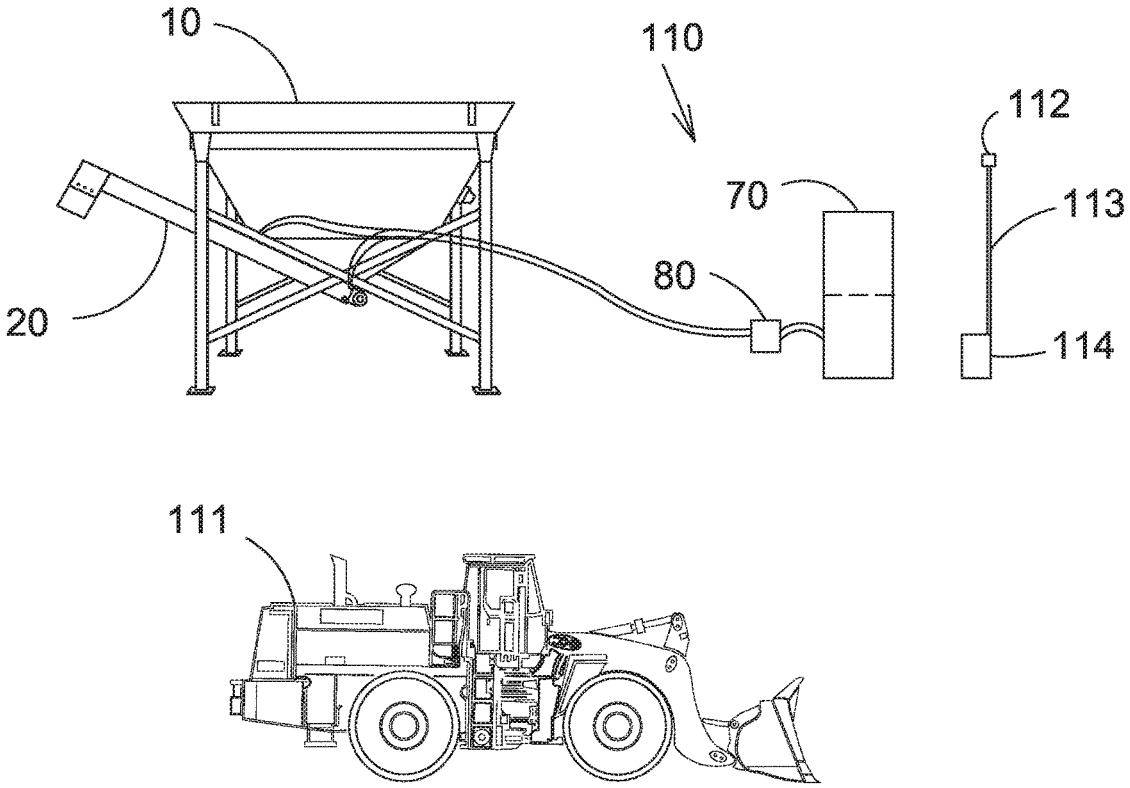
FIG. 10 is a schematic view of an electric system of the present invention.

Turning now to FIG. 10, it is seen that a preferred electric system is 110 illustrated. The system 110 has a FOB 111 (or remote control) in a loader for being in communication with a FOB reader 112 that is on an antenna 113 connected to an electric panel 114. The panel is in electronic communication with the other system components such as the pump and auger motor. A loader operator can use the FOB 111 to wirelessly communicate with FOB reader 112. Hence, the loader can activate the system 5 to prepare an amount of the mixture 3 according to the present invention without leaving his or her loader.

Thus it is apparent that there has been provided, in accordance with the invention, a machine for mixing and conveying a road application mixture and to the methods of use thereof that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A system comprising:

a hopper for containing a solid;

a pump for pumping a liquid;

an auger casing having an auger casing interior and an auger casing exterior, said auger casing having a liquid inlet for introducing an amount of said liquid into said auger casing interior from said pump and a solid inlet for introducing an amount of said solid into said auger casing interior from said hopper, said auger casing also having an auger casing discharge; and an auger enclosed within and completely surrounded by said auger casing; said auger mixing and conveying said liquid and said solid within said auger casing wherein said auger has a first flight section and a second flight section, said amount of said liquid entering said auger casing interior through said liquid inlet, said liquid inlet being located at a start of said second flight, wherein said first flight section has a first flight section pitch and said second flight section has a second flight section pitch, wherein said second flight second pitch is greater than said first flight section pitch, whereby said solid is conveyed at a faster rate of speed in said second flight section.

2. The system of claim 1 wherein said first flight section pitch is approximately 8 inches and said second flight section pitch is approximately 12 inches.

3. The system of claim 1 wherein said second flight section has at least one rod generally parallel to an auger longitudinal axis.

4. The system of claim 1 wherein said second flight section has at least one rod generally perpendicular to an auger longitudinal axis.

5. The system of claim 1 wherein said auger first flight section is approximately 4 feet in length and said auger second flight section is approximately 11 feet in length.

6. The system of claim 1 wherein said system is activated and deactivated via remote control.

7. The system of claim 1 wherein:

said auger has an empty amperage when said auger is turning when said auger casing is empty and has an amperage greater than said empty amperage when an amount of said solid is introduced into said auger casing when said auger is turning; and said pump turns on automatically to pump said liquid into said auger casing when said amperage is greater than said empty amperage preventing said liquid from being introduced into said auger casing when said auger casing is empty.

8. The system of claim 7 wherein the pump turns off automatically when the amperage approaches said empty amperage.

9. The system of claim 1 wherein said solid is comprised of pieces of salt.

10. The system of claim 9 wherein said pieces of salt are fully wetted within said auger casing as said auger mixes and conveys said pieces of salt to said discharge.

11. The system of claim 1 wherein:

said auger casing has a first end and a second end, said discharge being located at said second end and said solid inlet being located at said first end;

said auger is held on an incline wherein said discharge is located at a higher location than said solid inlet;

said liquid inlet is a first liquid inlet and is located between said solid inlet and said discharge; and said system further comprises:

a second liquid inlet between said solid inlet and said first end; and a drain plug at said first end.

12. The system of claim 11 wherein said discharge is located at a higher location than said liquid inlet, wherein the liquid introduced into said auger casing is mixed with said solid prior to being discharged from said auger casing.

13. A system comprising:

a hopper for containing a solid comprised of pieces;

a pump for pumping a liquid;

an auger casing having an auger casing interior and an auger casing exterior, said auger casing having a liquid inlet for introducing an amount said liquid into said auger casing from said pump and a solid inlet for introducing a plurality of said pieces of said solid into said auger casing from said hopper; and an auger operable and enclosed within said auger casing, wherein said auger both mixes and conveys said liquid and said plurality of said pieces of said solid, and said auger can be activated and deactivated with a remote control wherein:

said auger has a first flight section with a first flight section pitch;

said auger has a second flight section with a second flight section pitch;

said second flight section pitch is greater than said first flight section pitch, whereby said solid is conveyed at a faster rate of speed in said second flight section;

said auger is held on an incline, wherein said auger casing has a discharge that is located at a location that is higher than said solid inlet, wherein the liquid introduced into said auger casing is mixed with said plurality of said pieces of said solid prior to being discharged from said auger casing; and said amount of said liquid enters said auger casing interior through said liquid inlet, said liquid inlet being located at a start of said second flight section.

14. The system of claim 13 wherein said auger casing has a first end and a second end, and said system further comprises a drain plug at said first end.

15. The system of claim 13 wherein said auger has an empty amperage when said auger is turning when said auger casing is empty and has an amperage greater than said empty amperage when said plurality of pieces of said solid are introduced into said auger casing when said auger is turning; and wherein said pump turns on automatically to pump said liquid into said auger casing when an amperage is greater than said empty amperage preventing said liquid from being introduced into said auger casing when said auger casing is empty and turns off automatically when the amperage approaches said empty amperage.

16. A system comprising:

a hopper for containing a solid;

a pump for pumping a liquid;

an auger casing, said auger casing having a liquid inlet for introducing an amount of said liquid into said auger casing from said pump and a solid inlet for introducing an amount of said solid into said auger casing from said hopper; and an auger within said auger casing, said auger having an empty amperage when said auger is turning when said auger casing is empty and has an amperage greater than said empty amperage when said amount of said solid is introduced into said auger casing when said auger is turning;

wherein said pump turns on automatically to pump said amount of said liquid into said auger casing when an amperage is greater than said empty amperage preventing said liquid from being introduced into said auger casing when said auger casing is empty and turns off automatically when the amperage approaches said empty amperage.

17. The system of claim 16 wherein:

said auger has a first flight section with a first flight section pitch;

said auger has a second flight section with a second flight section pitch, said second flight section has a second flight section start;

said auger casing having an auger casing interior and an auger casing exterior;

said liquid inlet being located at said second flight section start;

said second flight section pitch is greater than said first flight section pitch, whereby said solid is conveyed at a faster rate of speed in said second flight section; and said auger is held on an incline, wherein said auger casing has a discharge that is location at a location that is higher than said solid inlet, wherein the liquid introduced into said auger casing is mixed with said plurality of pieces of solid material prior to being discharged from said auger casing.

* * * * *